United States Patent [19]

Dennis

[11] 4,315,256

[45] Feb. 9, 1982

[54] CHIMNEY FIRE DETECTOR

[76] Inventor: John R. Dennis, P.O. Box 396, Milford, Pa. 18337

[21] Appl. No.: 116,002

[22] Filed: Jan. 28, 1980

[51] Int. Cl.[3] ..... G08B 17/06

[52] U.S. Cl. ..... 340/590; 340/584

[58] Field of Search ..... 340/590, 584, 594, 593

[56] References Cited

U.S. PATENT DOCUMENTS

| | | | |
|---|---|---|---|
| 1,973,272 | 9/1934 | Sremec | 340/590 |
| 2,185,944 | 1/1940 | Holmes | 340/590 |
| 2,518,789 | 8/1950 | Jackson | 340/590 |
| 3,046,536 | 7/1962 | Sciuto | 340/590 |
| 3,257,530 | 6/1966 | Davies | 340/590 |
| 3,721,956 | 3/1973 | Hamann et al. | 340/65 |
| 3,774,184 | 11/1973 | Scarelli | 340/590 |

*Primary Examiner*—Glen R. Swann, III

*Attorney, Agent, or Firm*—Ronald G. Goebel; H. Hume Mathews

[57] ABSTRACT

A chimney fire detector has a pair of entwined conductors mounted at the outlet of the chimney. A sensing device can detect electrical contact between these conductors. An insulating spacer is mounted between these conductors for separating them. This spacer is formed of material which allows the conductors to pass through the material and touch in response to temperatures in excess of a predetermined magnitude. This predetermined magnitude corresponds to the temperature at the outlet of the chimney during a chimney fire.

7 Claims, 6 Drawing Figures

CHIMNEY FIRE DETECTOR

BACKGROUND OF THE INVENTION

The present invention relates to chimney fire detectors, and in particular, to detectors employing a pair of entwined conductors to detect the presence of a chimney fire.

It is known to use a twisted pair of insulated wires as the sensor for detecting a fire. Such known fire detectors rely upon the insulation between the pair either melting or disintegrating to thus allow the wires to make electrical contact. Such electrical closure operates an alarm or similar device to alert occupants of a building of the danger of fire. Such a twisted pair of wires have been used to detect fires within a building but not to detect chimney fires.

Chimney fires result from the progressive deposition of creosote on the inside surface of a chimney during its use. This creosote is typically emitted from a wood burning fire. If the user does not regularly remove these deposits, there is a significant danger that a relatively hot fire will cause combustion gases within the chimney to rise to a temperature sufficient to ignite the creosote deposit. The resulting chimney fire is dangerous since it issues dangerous sparks and flames from the outlet of the chimney. In addition the chimney temperature will exceed its design limits, thereby posing a danger of combustion to surrounding wooden frame members. The chimney fire, being difficult to extinguish, may require the assistance of emergency personnel and involve possible water damage to the chimney and its heating system.

It is known to install a temperature sensing unit within a chimney to detect a chimney fire. An example of such a detector is shown in U.S. Pat. No. 1,973,272. However, these detectors do not employ a twisted pair of wires and instead rely on more elaborate, and expensive equipment. Examples of fire detectors employing twisted pairs of wire to detect fires other than a chimney fire are disclosed in U.S. Pat. Nos. 2,185,944; 2,518,789; 3,046,536; 3,257,530; and 3,774,184.

SUMMARY OF THE INVENTION

In accordance with the illustrative embodiments demonstrating features and advantages of the present invention, there is provided a chimney fire detector which includes a pair of entwined conductors, a sensing means and an insulating spacer. The pair of entwined conductors is arranged to be mounted at the outlet of the chimney. The sensing means is operable to detect electrical contact between these conductors. The insulating spacer is mounted between these conductors for separating them. This spacer is formed of a material which allows the conductors to pass current in response to temperature exceeding a predetermined magnitude. This predetermined magnitude corresponds to the temperature at the outlet of the chimney during a chimney fire.

Also in accordance with the present invention, there is provided a method for detecting chimney fires. This method comprises the step of mounting a pair of entwined conductors at the outlet of a chimney. This pair of conductors is normally separated by an insulator until its temperature exceeds a predetermined magnitude. Another step of the method is measuring the electrical continuity between the pair of conductors.

By employing the foregoing equipment or method a relatively simple and reliable fire detector is provided which is well-adapted to detecting a fire within a chimney. In a preferred embodiment the fire detector is a simple twisted pair of insulated wires. Such a pair is relatively immune to the deleterious effects of wind, sun and other environmental factors. Moreover, such a detector is readily installed within the outlet of a chimney where the flue temperatures may normally rise to about 600° F. Well known insulators can be used with the twisted pair which can withstand the extremes of temperatures usually occuring at the outlet of a chimney. However, the insulator can be chosen to melt rapidly or disintegrate when a chimney fire elevates the chimney temperature to unusually high levels.

In a preferred embodiment the twisted pair of wires is connected to an alarm mounted within the building being protected. This alarm includes a semiconductor switch which conducts and remains conductive in response to electrical contact between the twisted pair of conductors. Preferably, this alarm continues to sound even though the contact between the twisted pair of conductors may be intermittent. This latter feature is significant where there is the possibility that a relatively violent chimney fire may cause the wires themselves to melt, thus ending continuity.

It is anticipated that for some embodiments the outer end of the entwined pair of conductors may incorporate an insulator having a higher melting temperature than the other portions. This feature is important since the portion within the chimney must be relatively immune to the normally high temperatures while the remaining portions, which may be strung inside the building, may be relatively sensitive to heat. As a result, the low temperature portions of the twisted pair of conductors will rapidly detect a fire within the building being protected even before flames reach the pair of conductors.

It is significant to note that the twisted pair of conductors provide fire protection and detection along its entire length. Moreover, several twisted pairs may be connected in parallel so that a single alarm unit can serve several chimneys and rooms. Again, these other branches provide fire protection and detection along their entire lengths.

All of these and other features and advantages are provided by a relatively simple, reliable and compact device which may be mounted in any convenient location within a building.

BRIEF DESCRIPTION OF THE DRAWINGS

The above brief description as well as other objects features and advantages of the present invention will be more fully appreciated by reference to the following detailed description of a presently preferred but nonetheless illustrative embodiment in accordance with the present invention when taken in conjunction with the accompanying drawings wherein.

DETAILED DESCRIPTION OF THE PREFERRED EMBODIMENT

Figure 1:
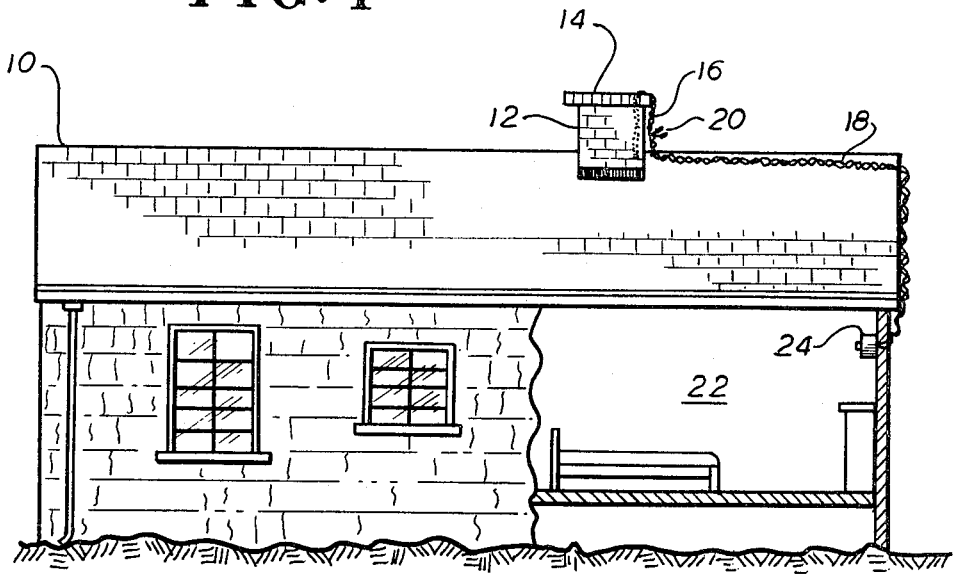
FIG. 1 is an elevational view showing the installation of a detector according to the present invention in a typical dwelling.

Referring to FIG. 1, a dwelling 10 is shown having a chimney 12 with an open upper outlet 14. A pair of entwined conductors separated by an insulating spacer is shown herein as outer pair of twisted wires 16 which is connected to lead pair of twisted wires 18 and splice 20. Twisted pair 18 leads into a bedroom 22 of dwelling 10. The inner end of twisted pair 18 is connected to sensing means 24 which is illustrated in further detail herein. As explained hereinafter, the insulation of pair 16 is an outer insulator with thermal properties that are different from the lead insulator of lead pair 18.

Figure 2:
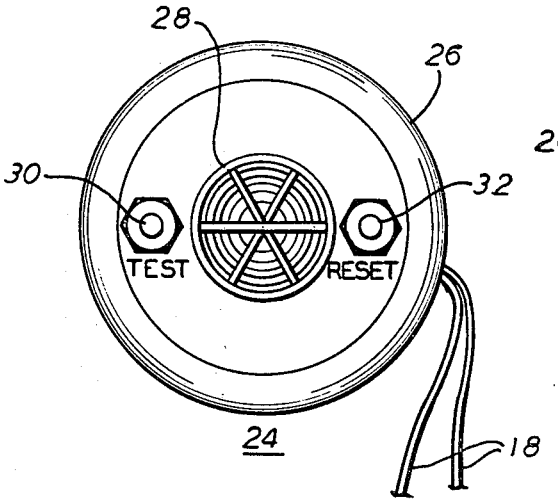
FIG. 2 is a detailed top view of the sensing means of FIG. 1.
Figure 3:
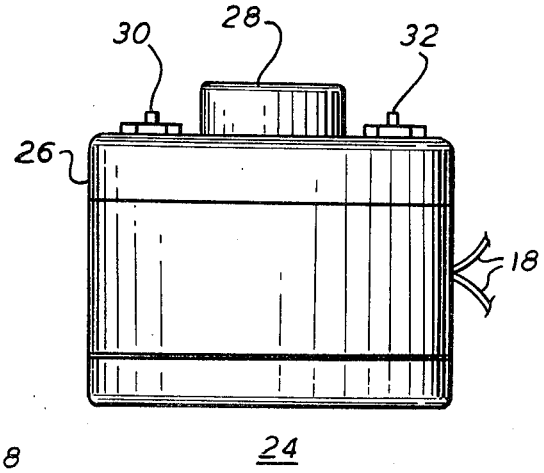
FIG. 3 is a detailed side view of the sensing means of FIG. 2.

Referring to FIGS. 2 and 3, a top and side view, respectively, is given of previously illustrated sensing means 24. Previously illustrated twisted pair 18 is shown terminating within casing 26 of sensing means 24. The sensing means 24 operates as an alarm means by employing an audible alarm, shown herein as buzzer 28, which can produce a piercing sound. Also shown herein are "test" push button 30 and a "reset" push button 32. The respective functions of these two buttons are described in further detail hereinafter.

Figure 4:
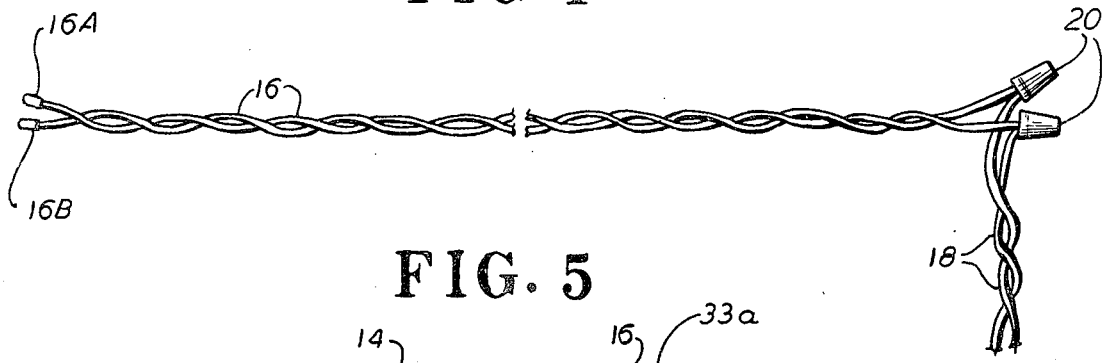
FIG. 4 is a detailed view of a portion of the pair of entwined conductors of FIG. 1.

Referring to FIG. 4 the previously illustrated outer pair 16 is shown in further detail. As shown in this view, each of the ends of twisted pair 16 is unconnected and each end 16A and 16B are sealed with epoxy or other suitable material to prevent the possibility of inadvertent contact between them. The outer pair 16 is shown connected to lead pair 18 by means of splicers 20. In this embodiment splicers 20 are water proof, quick disconnecting terminals.

The insulation of twisted pair 16 is preferably a fluorocarbon that is relatively insensitive to temperature up to 600° F. but melts at temperatures above 700° F. Of course, for installations where the normal chimney temperatures are significantly in excess of 600° F., alternative insulating material will be chosen with the appropriate temperature sensitivity.

Various other insulating materials may be substituted. These insulators will operate satisfactorily if they significantly change resistance, for example from $10^8$ to 50 megohms. Accordingly, it is not necessary for the insulation to completely melt or disintegrate. It is also important to note that the insulation of twisted pair 18 may be sensitive to a relatively low temperature. Indeed, it is desirable to have this insulation melt at a lower temperature. The portions thereof installed within the protected building should be able to detect a fire before the building temperature rises to an extreme corresponding to a fire which is out of control.

Figure 5:
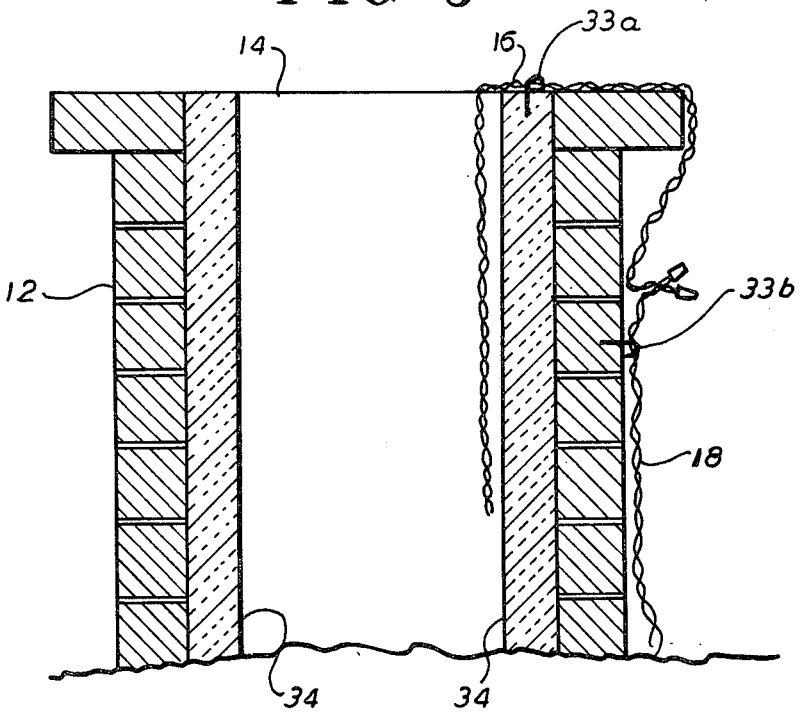
FIG. 5 is a detailed sectional view of the chimney installation of FIG. 1.

Referring to FIG. 5 the previously illustrated chimney 12 is shown in section. In this installation the outer pair 16 is shown hung vertically into outlet 14 of chimney 12. The mounting means in this embodiment are a pair of staples 33*a* and 33*b*. Typically the pair 16 extends into chimney 12 to a depth of about 2 to 3 feet. However, this depth may be increased or shortened depending upon whether the normal chimney temperature is unusually low or high, respectively. For installations where the normal chimney temperature is extremely high, it is anticipated that the outer pair 16 may be strung horizontally across the outlet 14 of chimney 12. If necessary, the outer pair 16 may be elevated above the upper edge of outlet 14 to prevent inadvertent destruction of the insulation of outer pair 16. Finally, it is anticipated that for some installations where chimney temperature is unusually low that the outer pair 16 will be deleted and the lead pair 18 will be inserted directly into outlet 14 of chimney 12.

Figure 6:
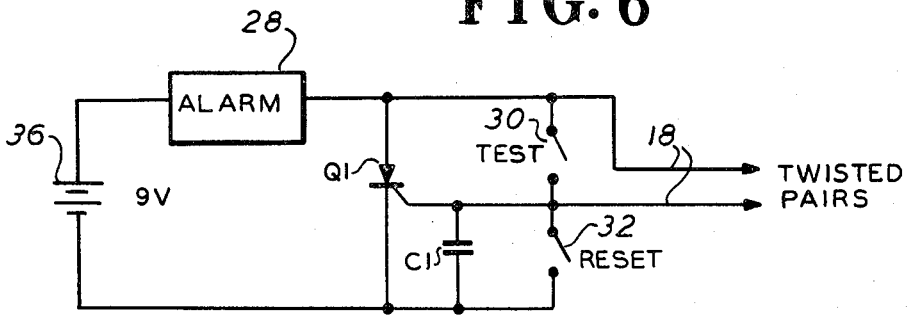
FIG. 6 is a schematic diagram of components within the sensing means of FIGS. 2 and 3.

Referring now to FIG. 6, a schematic diagram is given of the sensing means of FIGS. 2 and 3. This sensing means is shown herein as a semiconductor switch comprising thyristor Q1 (SCR). Lead pair 18 is shown connected across the gate and anode of thyristor Q1. Test switch 30 is connected in parallel with twisted pair 18 and reset switch 32 is connected across the gate and cathode of thyristor Q1. Switches 30 and 32 are both momentary contact, push button switches. A nine volt battery 36 has its positive terminal connected to alarm buzzer 28 and its negative terminal connected to the cathode of thyristor Q1. The other terminal of alarm buzzer 28 is connected to the anode of thyristor Q1. Capacitor CI (0.068 microfarad) is connected across switch 32 to shunt transients from the gate of thyristor Q1.

In operation, a short circuit between the gate and anode of thyristor Q1 will cause that device to conduct from its anode to cathode. Such a short may occur when test switch 30 is depressed or when a chimney fire causes lead pair 18 to short. The conduction from anode to cathode of thyristor Q1 can be terminated by actuation of reset switch 32 which terminates conduction in a well-known manner, provided lead pair 18 is open. Of course if pair 18 remains shorted due to a chimney fire, the alarm will continue sounding even if reset switch 32 is depressed.

To facilitate an understanding of the principles of the foregoing apparatus, its operation will be briefly described. After installation of outer lead pair 16 as previously described, the system (FIG. 6) may be tested by depressing test button 30 to actuate thyristor Q1 and sound alarm 28. Thereafter reset switch 32 is depressed to terminate the alarm. Assuming that a significantly large deposit of creosote has been deposited on the inside surface 34 of chimney 12, a sufficiently high chimney temperature will ignite this creosote layer. Consequently, flames or excessively hot combustion gases engulf outer pair 16 (FIG. 5). As a result, the insulation of pair 16 melts, allowing the twisted conductors to touch. Upon touching, an electrical connection is created between the gate and anode of thyristor Q1 (FIG. 6). Accordingly, a positive voltage is applied to the gate of thyristor Q1 causing it to conduct from its anode and cathode. Therefore, an electrical circuit is completed from battery 36 through alarm 28, causing it to sound. It should be noted that if a continuing chimney fire causes the conductors of pair 16 (FIG. 5) to melt and lose continuity, thyristor Q1 (FIG. 6) will continue to conduct for well-known reasons. The alarm 28 will continue to sound until reset push button 32 is depressed.

The commercial form of the alarm system disclosed in this Application may be designed for use within the home and has special features which make it particularly suited for the home with a wood stove or fireplace.

The Temperature Sensing Wires may be produced in two versions, Low-Temp and High-Temp. This feature allows the use of the Low-Temp type for installation in living quarters and will respond to temperatures in excess of 350° F., which is lower than the ignition temperature of most materials found in the home. The High-Temp type will respond to temperatures greater than 600° F. and is intended for use in "normally hot" locations, such as the chimneys of wood-burning stoves or fireplaces.

A very desirable feature of the system is the fact that any number of Sensing Wires of any length can be connected to a single Master Fire Alarm. Also, a number of additional Remote Alarms can be operated from one Master Alarm.

Both "Standard" and "Deluxe" Systems may be supplied with the Temperature Sensing Wires connected to the Master Fire Alarm. Fifty feet of Low-Temp Wire is connected to the Master Alarm and six feet of High-Temp Wire is connected to the other end of the Low-Temp Wire. Every inch of both Sensing Wires acts as a fire detecting system.

This arrangement is particularly intended for installation in a home with a wood stove or fireplace. The High-Temp Wire is dropped down the top of the chimney a few feet, the Master Alarm placed in the sleeping quarters of the home and the Low-Temp wire is run from the chimney to the Master Alarm, passing near the stove or fireplace to provide protection against chimney fires and excessive heat conditions near the wood-burning device.

In addition, the "Deluxe" System may be prewired with an additional fifty foot Low-Temp/six foot High-Temp Sensing Wire combination for homes with two chimneys and stoves or fireplaces. Also, a Remote Fire Alarm is provided with fifty feet of wiring to be connected to the Master Alarm. This Remote Alarm can be placed in another area where the Master Alarm might not be easily heard.

Installation of the commercial form of the fire alarm system disclosed in this Application may be as follows:

(1) Place the Master Fire Alarm in the sleeping quarters of the home—preferably the master bedroom.

(2) Select a location which will allow sufficient Sensing Wire to reach to the top of the chimney, with two to three feet dropped down the chimney. If possible, follow a path with the Wire which passes near the wood-burning apparatus, so that the Low-Temp Wire can detect unusually high temperature from or near the apparatus.

(3) In a large home more than one Alarm may be required for adequate protection. If so, a number of additional Remote Alarms can be used.

(4) Additional Sensing Wires can also be attached to the same Master Alarm—as many as desired. Sensing Wires can be installed in areas of potentially higher fire risk, such as near central heaters, electrical junction boxes, stoves, fans, etc.

The High-Temp Sensing Wire should be installed in a different manner in chimneys which have normal operating temperatures above 600° F. near the top of the chimney. Most chimneys have normal operating temperatures, near the top, much less than this, even during very hot fires. Although no absolute rule can be given, very short chimneys (less than 12 feet total stovepipe and chimney) may have temperatures greater than 600° near the top.

If there is any question whether the chimney exceeds this 600° F. limit, a TEST WIRE may be included with each system. This is made up of a short length of High-Temp Wire tied to a longer length of Low-Temp Wire.

To test the chimney:

(1) Drop the TEST WIRE into the chimney from the top, High-Temp Wire first (the short one) and attach the other end so that you can retrieve it after testing.

(2) Start a good *hot* fire (be sure the chimney is fairly clean so that you do not ignite any creosote accumulation in the chimney). Keep the fire blazing for two or three hours.

(3) Remove the TEST WIRE from the chimney.

(4) Wipe it clean with a clean cloth and inspect the insulation for signs of melting. If the insulation of the short HIGH-TEMP section is still intact, unmelted, you can install the System according to the previous instructions. If the longer Low-Temp section is also intact, not melted, then your chimney has a low operating temperature, less than 350° F. If the Low-Temp section is melted but the High-Temp is not, then the chimney has an operating temperature between 350° and 600° F.

Even if the High-Temp section of the TEST WIRE is melted, the system can still be used but the High-Temp Sensing Wire must not be installed inside the chimney. Instead, place the wire directly across the opening of the top of the chimney, a few inches above it, and fasten it at both ends. Flames or excessive heat during a chimney fire shoot out the top of the chimney and will activate the Alarm.

It is to be appreciated that various modifications may be implemented with respect to the above described preferred embodiment. For example, various insulating materials may be used on twisted pairs 16 and 18 to provide various thermal responses. In addition, numerous alarm devices including visual alarms may be substituted for or added to the alarm described herein. Furthermore, other switching devices may be employed, including latching electromechanical switching devices. Moreover, the equipment described herein may be energized by a battery or by house current.

Obviously, many other modifications and variations of the present invention are possible in light of the above teachings. It is therefore to be understood that within the scope of the appended claims, the invention may be practiced otherwise than as specifically described.

What is claimed is:

1. A chimney fire detector comprising:

an outer pair of twisted wires having an outer portion mounted at the outlet of said chimney;

a lead pair of twisted wires connected to said outer pair of twisted wires;

sensing means connected with said lead pair of twisted wires for detecting electrical contact between said lead pair of twisted wires or between said outer pair of twisted wires;

an outer insulator mounted between said outer pair of twisted wires; and a lead insulator mounted between said lead pair of twisted wires, said outer and lead insulators allowing said outer and lead pairs of twisted wires, respectively to contact electrically in response to temperatures in excess of different predetermined temperatures.

2. A chimney fire detector according to claim 1 wherein said outer insulator has a higher melting temperature than said lead insulator.

3. A chimney fire detector according to claim 1 wherein said sensing means is operable to produce a warning signal that continues after electrical contact between said pair of entwined conductors ceases.

4. A chimney fire detector according to claim 3 wherein said sensing means comprises:

an audible alarm; and a semiconductor switch serially connected with said alarm, said semiconductor switch having a control electrode coupled to said pair of conductors.

5. A chimney fire detector according to claim 4 wherein said semiconductor switch comprises a thyristor.

6. A chimney fire detector according to claim 1 further comprising:

means for mounting said outer pair of twisted wires at the outlet of said chimney.

7. A chimney fire detector according to claim 6 wherein said means for mounting is arranged to vertically hang said outer portion of said outer pair of twisted wires into the outlet of said chimney.

* * * * *